US005997711A

United States Patent [19]

Bourke

[11] Patent Number: 5,997,711

[45] Date of Patent: Dec. 7, 1999

[54] CONTROL AGENT FOR REDUCING METAL ACID MIST EMISSIONS FROM ELECTROLYTIC CELL OPERATIONS

[75] Inventor: Steven H. Bourke, Tucson, Ariz.

[73] Assignee: AON International, Inc., Tucson, Ariz.

[21] Appl. No.: 08/883,787

[22] Filed: Jun. 27, 1997

Related U.S. Application Data

[60] Provisional application No. 60/020,764, Jun. 28, 1996.

[51] Int. Cl.[6] ..... C25D 21/11

[52] U.S. Cl. ..... 205/94; 204/279; 204/471; 205/283; 205/334; 205/560; 205/571; 205/574; 205/597; 205/602; 205/640

[58] Field of Search ..... 205/94, 283, 560, 205/574, 557, 536, 351, 334, 640, 565, 571, 597, 602; 204/279, 471

[56] References Cited

U.S. PATENT DOCUMENTS

| | | | |
|---|---|---|---|
| 2,223,973 | 12/1940 | Teats | 205/94 |
| 3,657,080 | 4/1972 | Chessin | 205/94 |
| 3,755,095 | 8/1973 | Boycott, Jr. | 205/94 |
| 3,948,747 | 4/1976 | Cordiana et al. | 204/242 |
| 5,104,496 | 4/1992 | Dupree | 205/94 |

FOREIGN PATENT DOCUMENTS

| | | |
|---|---|---|
| 1587381 | 3/1970 | France . |
| 2077500 | 4/1987 | Japan . |
| 161199 | 3/1964 | U.S.S.R. . |
| 872602 | 10/1981 | U.S.S.R. . |
| 1723208 | 3/1992 | U.S.S.R. . |
| 1723208 A1 | 3/1992 | U.S.S.R. . |

OTHER PUBLICATIONS

C.T. Thomas, "The Conservation of Chromic Acid in Chromium Plating", The Monthly Review, pp. 720–721, Aug. 1943.

C.T. Thomas, The Conservation of Chromic Acid in Chromium Plating, The Monthly Review, American Electroplating Society, pp. 720, 722, Aug. 1943.

Arthur Stern et al, The Use of Plastic Beads on Chrome Plating Tanks, News Notes, pp. 67N–68N, date not available.

*Primary Examiner*—Kathryn Gorgos
*Assistant Examiner*—William T. Leader
*Attorney, Agent, or Firm*—Mueller and Smith, LPA

[57] ABSTRACT

Disclosed is a method for reducing metal acid or salt evolved from electrolytic baths housed in electrolytic tanks during electrolytic operations. This method involves covering all of the surface of the electrolytic bath with a layer of shredded foam (e.g., polymeric foam, metal foam, glass foam, or vitreous material foam). The shredded foam is irregular in shape, lacking in uniform particle size, is inert to the electrolytic operation, and floats at the surface of the electrolytic bath. Desirably, the layer of shredded foam is about 3 to 4 inches (76–102 mm) in thickness. Examples of specific processes benefiting from the present invention are anodizing, electroplating, electrowinning, and electrophoresis operations.

20 Claims, No Drawings

CONTROL AGENT FOR REDUCING METAL ACID MIST EMISSIONS FROM ELECTROLYTIC CELL OPERATIONS

CROSS-REFERENCE TO RELATED APPLICATIONS

This application is a continuation-in-part of provisional application Ser. No. 60/020,764, filed Jun. 28, 1996, the disclosure of which is expressly incorporated herein by reference.

BACKGROUND OF THE INVENTION

Electrolytic operations can include, for example, anodizing, electroplating, electrowinning, electrophoresis, and the like. Basically, an electrolytic bath is housed within an electrolytic cell in which an anode and a cathode are placed. Upon the application of electricity through such electrodes, current is carried by electrolytes in the water (without electrolytes, the water will be subjected to electrolysis). Two oft commercially practiced electrolytic operations will be used to illustrate the precepts of the present invention: electroplating and electrowinning. It will be appreciated that such description is by way of illustration and is not a limitation on the present invention.

Presently, many metals are electroplated on a commercial scale, e.g., aluminum, antimony, bismuth, cadmium, chromium, cobalt, brass, bronze, iron, lead, copper, gold, platinum, rhodium, ruthenium, silver, tin, and zinc. Chromium electroplating, for example, is a widely-used process for depositing chromium metal onto a substrate, typicalily steel for hard chromium electroplating. Chromium offers combined properties not found in any other metal: hardness, high reflectance, high corrosion resistance, low coefficient of friction, high heat conductivity, and excellent wear resistance. Electroplating companies fall into two general categories: captives and job shops. Captive electroplating operations plate in-house manufactured parts and can be found throughout the United States in industries including major airlines, aerospace firms, computer and electronics manufacture, hardware manufacture, automotive companies, and the military. See Freeman (1995), *Industrial Pollution Prevention Handbook*, McGraw-Hill, New York, N.Y. Freeman also reports that there are about 3,000 job shop electroplating companies in the U.S.

In the chromium electroplating process, a direct current is applied between the anode and the cathode (the part) while suspended in a hexavalent chromium-plating solution. The bath temperature is usually kept at between 116° and 138° F. (46° and 59° C. The bath contains chromic anhydride, which creates an aqueous solution of chromic acid. Sulfuric acid also is present to act as a bath catalyst. At high concentrations (e.g., 225 to 375 g./L of chromic anhydride), the chromic acid forms dichromic acid, which then ionizes to dichromate and hydrogen ions.

Three chemical reactions take place at the cathode (part to be electroplated): (1) the deposition of chromium on the part surface, (2) the evolution of hydrogen gas, and (3) the reduction of hexavalent chromium to trivalent chromium. Three chemical reactions also take place at the anode: (1) the oxidation of the anode, (2) the evolution of oxygen gas, and (3) the oxidation of trivalent chromium to hexavalent chromium.

Chromium electroplating is a very inefficient process in that over 80% of the applied energy goes into the evolution of by-product gases: hydrogen and oxygen. The emission of chromic acid mist from the surface of hard-chrome plating tanks is largely a mechanical process. Hydrogen gas, evolved as a by-product of the redox reaction occurring when plating metallic parts with chromium, bubbles violently out of the solution and causes a boiling action at the surface of the tank. As hydrogen bubbles reach the surface of the tank and burst, a mist composed largely of chromic acid is formed. Additionally, air, often bubbled through the electroplating bath to aid in the mixing of the solution in order to avoid temperature stratification within the bath, also carries chromic acid mist with it as it is evolved from the surface of the tank.

Decorative hexavalent chromium electroplating is similar to hard chromium electroplating, except in: (1) the current applied, (2) the duration of plating, (3) the substrate plated, and, (4) the addition of brighteners and other substances to the bath. A thin layer of chromium is applied to the base material to provide a bright wear and tarnish-resistant surface. Because decorative parts generally are plated at lower currents and for less time then hard chromium electroplated parts, emission generation per surface plated usually also is less. Nevertheless, it is a very significant problem subject to extensive government regulation.

Chromium anodizing is the process of electrolytically oxidizing the surface of a substrate, typically aluminum. An oxidized layer on the surface of the part provides corrosion resistance, low conductivity, and accepting surface for coloring. Although there are different types of anodizing processes, chromium anodizing is preferred because chromic acid acts as a corrosion inhibitor and remains in the pores and crevices of the part after the process is complete. While less of a concern because of short plating cycles, emissions are still a major problem.

The carcinogenicity of hexavalent chromium compounds is well known. Workers involved in chromium electroplating comprise a population at high risk of overexposure to Cr(VI) in the form of chromic acid mist. Chromium and its compounds have been the topic of more epidemiological investigations than any other chemical exposure agent, with the possible exceptions of asbestos and benzene. Lees (1991), "Chromium bands disease: review of epidemiologic studies with particular reference to etiologic information provided by measures of exposure", *Environmental Health Perspectives*, 92, 93–104. Hexavalent chromium has been shown to cause cancer in humans and in experimental animals, as well as exert genetic toxicity in prokaryotes and mammalian cells in vitro. Norseth (1981), "The carcinogenicity of chromium", *Environmental Health Perspectives*, 40, 121–130. Under the Clean Air Act Amendments of 1990, the U.S. Environmental Protection Agency (USEPA) has designated chromium compounds as hazardous air pollutants suspected of causing lung cancer in humans. The USEPA has promulgated a National Emission Standard for Hazardous Air Pollutants (NESHAP) that regulates the chromium air emissions generated from chromium electroplating and anodizing operations (60 FR 4948). Additionally, individual states may have different (or additional) regulations. Moreover, most state regulations are more stringent than the national standard and may be based on ground level concentrations or risk-based assessments.

End-of-pipe control technologies have been an accepted method of treating fugitive emissions from the hard chromium electroplating industry. The term "end-of-pipe" denotes the treatment of a contaminated air stream that has been drawn off a plating tank by a blower. Suppressing chromium emissions at the tank level should reduce the amount of chromium at the inlet to end-of-pipe control devices or even eliminate the need for such control devices.

Techniques aimed at suppressing chromium emissions from electroplating tanks include chemical foaming agents, small plastic balls, or both used in concert. A study performed by the California Air Resources Board presents data showing that process modifications (specifically, plastic balls, chemical fume suppressants, and elimination of air agitation) will reduce chromium emissions by 50% to 60%. Weintraub, et al., "A systems approach to controlling chrome electroplating emissions", *Proceedings of the 34th Annual Meeting & Exhibition*, Air & Waste Management Association (AWMA), Jun. 1991, pp 91–103.

Chemical foam blankets provide multiple barrier surfaces with which to collect the mist before being released into the air. Foam blankets have the disadvantage that they can (and often do) trap by-product hydrogen and oxygen gases, thereby forming an explosive mixture. Jordan, Chromium emissions from chromium electroplating and chromic acid anodizing, operations—Background information for promulgated standards, (EPA Publication No. EPA-453/R-94-082b)., Research Triangle Park, N.C.: U.S. Environmental Protection Agency. (NTIS Publication No. PB95166302); and Sheehy, et al. (1984), NIOSH technical report: Control technology assessment: Metal plating and cleaning operations, (DHHS [NIOSH] Publication No. 85-102, Cincinnati, Ohio: National Institute for Occupational Safety and Health, (NTIS Publication No. PB85-234391). Plastic balls (usually polypropylene) of about 30 mm diameter can be floated on the chromium solution to reduce the exposed surface are of the bath and to provide a surface for the mist to deposit on and drain back into the plating solution. However, there is a tendency for the balls to be pushed away from the electrodes by the surface disturbances causes by rising bubbles. Unfortunately, this is the location at which the balls are needed the most to reduce emissions.

Other proposals include, for example, U.S. Pat. No. 3,755,095 which proposes the use of 0.002 to 100 micron size polyethylene powder to reduce chromic acid emissions from the electroplating tank; U.S. Pat. No. 3,657,080 which proposes 0.002 to 100 micron hydrophobic particles (e.g., silica) to reduce chromic acid emissions from the electroplating tank; Russian Pat. No. 1,723,208 which proposes the use of a lower polyethylene granule layer and an upper plastic foam layer; Russian Pat. No. 872,602 which proposes the use of two layers of polymer particles with the top layer pretreated with paraffin wax; and Russian Pat. No. 161,199 which also proposes the use of a combination of 4 mm or smaller polyethylene balls and a chemical foam. David (1946), "Method of reducing chromic acid spray in plating tanks", *Safety Review*, 3, 13–15, reports a study in which plastic chips were evaluated as a means of reducing chromic acid mist emission from plating tanks, including crushed Lucite crystals measuring approximately ¼ inch by ¼ inch, squares of scrap methacrylate, and polystyrene rods measuring approximately ¼ inch in diameter by 2 inches in length. Davis also reports that in 1926 a German scientist discussed using cork particles or glass wool coated with paraffin to reduce emissions from chrome plating tanks.

Further background information can be found in Hey, "Abatement of Hazardous Air Pollutant Emissions From Army Chromium Electroplating And Anodizing Operations", U.S. Army Construction Engineering Research Laboratories (USACERL), January 1996, (NTIS Publication No. ADA304841) and Fowler (December 1996), An evaluation of the efficacy of styrofoam as a control agent for reducing chromic acid mist emissions from plating tanks in hard-chrome plating operations, Master's thesis, The University of Arizona, Tucson, Ariz. The disclosures of all of the foregoing references are expressly incorporated herein by reference.

Another electrolytic cell process that produces acid vapors and can result in air-borne acid (or salt thereof) and metal above the cell is known as "electrowinning". Electrowinning techniques have been applied to many metals, including copper, gold, lead, and zinc on a commercial scale. By way of example with reference to the electrowinning of copper, basically, electrowinning is a minor ore dressing technique whereby copper ions in an aqueous bath are "plated" out on starter cathodes. One such process practiced commercially leaches copper values from low grade copper ore stockpiles with slightly acidic water to form a "pregnant leach solution" that is extracted with a kerosene-based solvent. The lower raffinate layer is recycled to the ore stockpiles while the Lapper "loaded organic" phase is sent to a stripping tank to be stripped with an electrolyte. After settling, the upper organic phase depleted of copper values is recycled for reuse and the lower "rich electrolyte" is sent to an electrowinning tank house in which tanks are fitted with alternating lead anodes and starter sheet copper cathodes (typically about 38"×38" (96.5×96.5 cm) in size). The bath temperature usually is maintained at about 120°–135° F. (48.9°–57.2° C.). Electrowinning is conducted at rather low currents relative to other plating processes, e.g., 2 v and a current density of 30 amps/ft$^2$ (1,462 amps/m$^2$). After several days in the tank house, approximately 250 pound (112.5 kg) copper cathodes are withdrawn and new copper starter sheets are inserted into the baths. The withdrawn copper cathodes are ready for sale or for further processing. Acid vapors are released from the cells and can carry copper metal along with it. Sulfates (including copper) coming off the tanks generally are in the order of 2–10 mg/m$^3$. OSHA limits are 1 mg/m$^3$ presently and may be reduced in the near future.

While electrowinning is not a "plating" operation in the traditional sense, it is an electrolytic process that results in a metal being plated from an aqueous acidic bath in an electrolytic cell. Again, like chrome electroplating, electrowinning is another example of an electrolytic cell process that could benefit from having its contents' propensity to be released (aerosolization) from the bath suppressed.

BRIEF SUMMARY OF THE INVENTION

Disclosed is a method for reducing metal acid or salt, or other contaminants, evolved from electrolytic baths housed in electrolytic tanks during electrolytic operations. This method involves covering all of the surface of the electrolytic bath with a layer of shredded foam (e.g., polymeric foam, metal foam, glass foam, or vitreous material foam). The shredded foam is irregular in shape, lacking in uniform particle size, and is inert to the electrolytic operation. Desirably, the layer of shredded foam is about 3 to 4 inches (76–102 mm) in thickness, though the layer thickness will vary by application. Examples of specific processes benefiting from the present invention are anodizing, electroplating, electrowinning, and electrophoresis operations. Reductions in chromic acid from chrome electroplating tanks, for example, can be reduced by 96% or more compared to the use of no control layer on the tanks, while copper electrowinning operations, for example, can have emissions reduced by up to 99.5%.

Advantages of the present invention include the ability to substantially reduce electrolytic cell emissions. Another advantage is the ability to use a control blanket that is made from a very inexpensive material. A further advantage is that control blanket also acts an insulator. These and other advantages will become readily apparent to those skilled in the art.

DETAILED DESCRIPTION OF THE INVENTION

It will be apparent that a great need exists in the control of metal acid mists emanating from electrolytic process tanks. Government regulation in the U.S. mandates that chromic acid in electroplating operations be controlled. Despite the recognized need for chromic acid emission reduction, most electroplaters choose to clean the air above the tanks to remove chromic acid from the air rather than reduce the amount of chromic acid evolved from the tanks during plating operations. It should be understood that the terms "electroplating" and "plating" will be used interchangeably in this application, but that these terms are synonymous. Also, the term "chromic acid" often is used to denote the chromium substance evolved from the tank. This term is illustrative and is meant to include chromium in any form evolved from an electroplating tank during chromium electroplating operations (usually "hard chrome" plating).

As the examples will demonstrate, however, the invention solves the unwanted aerosolization of materials (acids, acid salts, mixtures thereof, etc.) within an electrolytic cell and preferably where electroplating operations are being practiced. Most often, the need for aerosolization suppression is associated with acidic baths that contain metal (e.g., chromium, copper, etc.) and where hydrogen gas is evolved as a by-product of the electrolytic process. Thus, the precepts of the invention make the invention appropriate for use in a wide variety of electrolytic operations.

A particular polymeric foam that has proven effective in reducing chromic acid is an expanded polystyrene foam characterized by its buoyancy (porosity) as it has been foamed, its irregular shape as it has been shredded, its lack of uniformity in particle size due to the shredding operation (ranging in size from microscopic to one inch or more in size), and its inertness to the particular electrolytic process. A thick layer of the shredded expanded polystyrene foam, say 3–4 inches (76.2–101.6 mm), will float "at the surface", which for present purposes, means that the polymeric blanket will be present slightly below the water line, at the water line, and above the water line. It is believed that this important in that the pointed prominences puncture gas bubbles which would otherwise convey chromic acid out of the tank. Less chromic acid, then, is carried out of the tank. Another characteristic exhibited by the preferred shredded polystyrene foam is the interlocking action exhibited by the irregular shaped particles of varying sizes which forms a tortuous path for the gas bubbles to follow in order to escape the surface of the bath—again, resulting in decreased chromic acid evolution from the bath.

The crushed foam is comprised of many different sized bits of polystyrene of various shapes and configurations. As a result, the bath surface coverage is fairly complete and uniform as any void volumes between the larger particles are quickly filled by the smaller particles. The surface of the foam is fairly coarse and shredding or fracturing of the foam serves to increase both the surface area and surface coarseness of the polymer since hundreds of tiny cells are ruptured and opened.

The porosity of the shredded polystyrene foam provides buoyancy and the cavities ("dead-air" pockets) either within the particles or formed by the interlocking action of the irregular particles (dendritic-like structure) traps the hydrogen gas, enabling chromic acid to be released by the gas bubbles, and permitting a controlled evolution of hydrogen gas from the bath rather than the violent bubbling action that normally is found in a chromium electroplating bath. Hydrogen is a much smaller molecule (in size) than is chromic acid, so that it can escape much more easily through the polymeric blanket. In this regard, the layer of shredded polystyrene foam at the surface of the tank bath calms the surface quite a bit, which also is beneficial to reduced chromic acid carry-out by the gas bubbles breaking the surface of the bath.

Without being bound by the following theory, it is believed that hydrogen bubbles generated within the bath travel upwardly and, as they reach the surface, they rupture, scattering chromic acid solution. With no barrier present, water and chromium acid aerosols become airborne. The larger the gas bubbles, the greater their buoyancy. Hence, larger bubbles tend to have elevated velocities and kinetic energy, which tends to increase the aerosolization of chromic acid and water. However, in the presence of a physical barrier, such as shredded or fractured polystyrene foam, the hydrogen gas bubbles encounter the foam and rupture before reaching the surface or are simply diverted into the existing voids and rupture. The rupturing of the hydrogen bubbles may be marginally facilitated by the coarse surface associated with the polystyrene foam, much like that of a balloon contacting a sharp object. Moreover, the surface coarseness of the foam and the tiny fractured cellular inclusions serve to trap the vapor particles. Since hydrogen gas molecules are very tiny (atomic radius=0.37 Å), they migrate through the small voids existing within the styrofoam blanket and escape into the atmosphere. The water and chromic acid vapors generated are much larger (~0.1 to 2 microns); as a result, they are trapped and left behind. By analogy, this is similar to the size difference between a grain of sand and an automobile. This same action is believed to occur regardless of the acid or salt whose containment in the electrolytic bath is desired.

Testing has revealed that, upon aging of the preferred polystyrene material (by its use), its effectiveness in reducing chromic acid release improves. This improvement could be the result of several factors including enhanced packing efficiency over time, a slight take-up of water by the foam, a slight softening of the foam by chemicals in the bath causing adjacent particles to "stick" together, or like action. Regardless of the, mechanism, the foam appears to improve in its effectiveness over time which is a definite benefit of the inventive process.

The foregoing description has concentrated on polystyrene foam and chrome electroplating operations by way of illustration and not limitation of the present invention. It is believed that other shredded foam compositions (e.g., polyolefins such as polyethylenes and polypropylenes, polycarbonates, silicones, urea/formaldehydes, ABS or acrylonitrile/butadiene/styrene copolymers, and the like) would similarly perform so long as they mimicked the physical properties described for the shredded polystyrene foam and were otherwise not detrimental (e.g., by chemical reaction) to the electroplating operation. The same is true for foamed metals (e.g., titanium, platinum, palladium, and the like), foamed glasses, foamed vitreous materials, and the like. Simply by foaming such other materials with air or other gas (e.g., nitrogen), the foamed materials could be made to have the same buoyancy as foamed polystyrene has (specific gravity of about 25–40 times less than water). Shredding of the foamed materials, then, would complete their preparation for use. Another unexpected development observed during testing of the present invention is that the shredded polystyrene foam did not retard the plating operation in either rate or efficiency, even when the shredded polystyrene foam occasionally contacted the part during the plating operation.

The following examples show how the present invention has been practiced, but should not be construed as limiting. All citations referred to herein are expressly incorporated herein by reference.

EXAMPLE I

Solid steel rods measuring 4 feet (1.22 m) in length and 5 inches (1.02 cm) in diameter were chosen for evaluating different techniques aimed at reducing the amount of chromic acid released from an electroplating tank having inside dimensions measuring 36 in (0.92 m) wide by 60 inches 1.53 m) long by 67 inches (1.7 m) deep and having a nominal 660 gallon (2,280 L) capacity and an exposed surface of 15 sq. feet (1.35 sq. m). The different techniques tested were:

Control—No control agent employed. Reduction in emissions by control agents based on this control.

Chemical Foam—Udylite Foam Lock® L Fume Suppressant (Enthone-OMI Inc., Warren, Mich.) diluted at a ratio of 1 L agent to 2 L deionized water (i.e., volumetric dilution of 1:3) applied to the tank surface at an application rate of 30 mL/hr or 0.5 mL/min in accordance with the manufacturer's recommendations.

Plastic Balls—Hard, white plastic hollow balls (0.75 in or 19 mm diameter) believed to be polypropylene in composition applied to cover the entire surface of the tank.

Plastic Balls plus Chemical Foam—Each as described above.

Shredded Polysterene—Styrofoam® (Dow Chemical U.S.A., Midland, Mich.) shredded into irregular pieces ranging in size from microscopic to an inch or more in size (reported specific gravity of 0.027 to 0.064) and used at about a 3 to 4 inches (76.2–101.6 mm) layer on the surface of the tank.

Shredded Aged Polystyrene—Extended test period of 14 actual plating days to evaluate performance of "aged" foamed polystyrene again used at about a 3–4 inch (76.2–101.6 mm) layer on the surface of the tank.

Electrolyte mist samples were collected and analyzed in accordance with NIOSH method 0500 (gravimetric analysis) and NIOSH method 7600 (visible light absorption spectrophotometry (National Institute for Occupational Safety and Health, 1994). Styrene samples were collected and analyzed with NIOSH method 1501 (gas chromatography, FID), as described by Jessen (1996), Recovery of styrene monomer vapor from activated charcoal with and without methyl ethyl ketone peroxide activation, Unpublished master's thesis, The University of Arizona, Tucson, Ariz. (see Fowler, supra). A plating tank was used in an area dedicated solely to the testing reported herein. No other work was performed in this area during the testing reported herein. All analytic equipment was calibrated and samples were taken at the same location in the same manner during all tests. Hydrogen gas concentrations above the plating tank were monitored using an electrochemical hydrogen sensor and control module (Control Instruments Corp., Fairfield, N.J.).

The steel rod was sanded to remove any oxidation and washed with lacquer thinner to remove oil residues imparted during machining and handling. The part then was lowered into the plating tank and allowed to warm up to the temperature of the bath(115–125° F. or 46.1°–51.7° C.)for a few minutes. The part then was etched by reversing the rectified poles and running 4 V of current through the tank for about 1.5 minutes. The rectified poles then were switched back and the part plated. Following plating, the part was suspended over the tank and washed with water to remove residual electrolyte from its surface. No air was bubbled through the tanks to not introduce another variable into the tests.

Hexavalent chromium concentrations recorded during each of the chromic acid mist control trials were compared to the levels observed when no control agent was employed using a Student's two sided t-test. Statistical significance is denoted by $P \leqq 0.05$. The following data were recorded.

TABLE I

| Control Agent | Observed Reduction in Emissions (%) | P-Value |
|---|---|---|
| Chemical Foam | 9.0 | P = 0.5651 |
| Plastic Balls and Chemical Foam | 52 | P < 0.001 |
| Plastic Balls | 64 | P < 0.001 |
| Shredded Polystyrene | 94.5 | P < 0.001 |
| Aged Shredded Polystyrene | 96.6 | P < 0.001 |

These data clearly establish the use of shredded polystyrene as a superior control agent in reducing chromic acid emissions from electroplating tanks. Plastic balls and chemical foams performed as about expected based on the literature. It is believed that the performance of the shredded polystyrene improves with time, although the results recorded here were not statistically significant on this point. Still, the invention offers a unique opportunity for chromium electroplating operations to reduce the amount of chromic acid evolved from the tanks during plating operations. It should be noted that no detectable styrene monomer was noted above the tank (estimated limit of detectability of approximately 0.1 mg/m$^3$).

EXAMPLE II

Electrowinning tests were conducted in a 2'×2'×2' (61 cm×61 cm×61 cm) cubic tank in which an electrolyte solution was placed to a depth of 1.5' (45.75 cm). An air baffle was constructed around the tank to prevent air drafts from influencing the accuracy of the test results. The baffle was approximately 4' (122 cm) high by 4' (122 cm) wide on each side of the tank. The test electrolyte used was taken from the electrolyte baths in commercial use at the Phelps Dodge Morenci, Ariz., mine. Analysis of the electrolyte showed that it contained 41 g/L of copper.

Air samples were taken above the tank using MSA Escort sampling pumps. The samples were collected on 37 mm diameter, 0.8 $\mu$m pore size mixed cellulose ester filters supplied by Millipore, Inc. The filters were loaded into plastic cassettes with backing pads also supplied by Millipore, Inc. The sampling pumps were calibrated on site immediately before and after sampling using a Gilibrator primary flow calibrator (Gilian Instrument Corp.). Samples obtained were analyzed by atomic absorption spectroscopy using NIOSH method 7029 by an independent laboratory.

Sample runs were conducted both with and without the use of the plastic foam on the surface of the bath. Air samples were taken at three locations on each run: directly over the copper cathode, and about 7" (17.8 cm) toward each side of the cathode. In each instance, the air samples were taken at 12" (30.5 cm) above the surface of the bath.

New shredded polystyrene as described in Example I was placed on the surface of the bath to a thickness of about 1" to 2" (25.4 to 50.8 mm) (a thickness of about 1" (25.4 mm) less than experience has shown to be optimum). Two different concentrations of electrolyte solutions were used: 41 g/L and 32 g/L). The standardized total test time for each run was 200 minutes. The results recorded are displayed below.

TABLE II

| Run No. | Sample No. | Time-Adjusted Copper Conc. ($mg/m^3$) | % Cu Reduction By Sample Location | Average % Cu Reduction |
|---|---|---|---|---|
| 1 | 6/5-01 | 0.039 | 98.7 | 98.7 |
| Foam | 6/5-02 | 0.049 | 98.5 | |
| | 6/5-03 | 0.034 | 99.0 | |
| 2 | 6/5-04 | 3.022 | 0 | 0 |
| No Foam | 6/5-05 | 3.297 | 0 | |
| | 6/5-06 | 3.319 | 0 | |
| 3 | 6/6-01 | 3.679 | 0 | 0 |
| No Foam | 6/6-02 | 3.852 | 0 | |
| | 6/6-03 | 3.401 | 0 | |
| 4 | 6/6-04 | 0.036 | 99.0 | 99.2 |
| Foam | 6/6-05 | 0.035 | 99.1 | |
| | 6/6-06 | 0.026 | 99.5 | |

These test results demonstrate the dramatic reductions in aerosolization of acidic vapors from electrowinning tanks. The level of copper concentration in the electrolyte did not appear to have a bearing on the effectiveness of the foam to suppress emissions from the tank. The shredded foam appeared to be more effective in copper electrowinning than in chrome plating. It is postulated that the lower voltages (2 v as compared to 6 v) produce smaller aerosols and less severe bath surface agitation than in chrome plating. Nevertheless, this data establishes the ability of the present invention to successfully suppress noxious emissions from electrolytic process tanks.

I claim:

1. A method for reducing metal acid or salt evolved from electrolytic baths housed in electrolytic tanks during electrolytic operations, which comprises:

covering all of the surface of the electrolytic bath with a layer of shredded foam that floats at the surface of said bath, said shredded foam being irregular and dendritic in shape, lacking in uniform particle size, and being inert to the electrolytic operation.

2. The method of claim 1, wherein said shredded foam is selected from polymeric foam, metal foam, glass foam, and vitreous material foam.

3. The method of claim 2, wherein the layer of shredded foam is about 76–102 mm in thickness.

4. The method of claim 2, wherein said shredded foam is made from a material selected from the group consisting of polystyrenes, polyolefins, polycarbonates, silicones, urea/formaldehyde resins, ABS copolymers, and titanium.

5. The method of claim 1, wherein said shredded foam ranges in size from microscopic to about 3 cm.

6. The method of claim 1, wherein said electrolytic operations comprise chrome electroplating and said metal acid comprises chromic acid.

7. The method of claim 1, wherein said electrolytic operations are selected from the group consisting of anodizing, electroplating, electrowinning, and electrophoresis.

8. The method of claim 7, wherein said electrolytic operations are selected from:

electroplating of a metal selected from the group consisting of aluminum, antimony, bismuth, cadmium, chromium, cobalt, brass, bronze, iron, lead, copper, gold, platinum, rhodium, ruthenium, silver, tin, and zinc; and electrowinning of a metal selected from the group consisting of copper, gold, lead, and zinc.

9. A method for reducing metal acid or salt evolved from electroplating baths housed in electroplating tanks during electroplating operations, which comprises:

covering all of the surface of the electroplating bath with a layer of shredded foam that floats at the surface of said bath, said shredded foam being irregular and dendritic in shape, lacking in uniform particle size, and being inert to the electroplating operation.

10. The method of claim 9, wherein said shredded foam is selected from polymeric foam, metal foam, glass foam, and vitreous material foam.

11. The method of claim 10, wherein the layer of shredded foam is about 76–102 mm in thickness.

12. The method of claim 10, wherein said shredded foam is made from a material selected from the group consisting of polystyrenes, polyolefins, polycarbonates, silicones, urea/formaldehyde resins, ABS copolymers, and titanium.

13. The method of claim 9, wherein said shredded foam ranges in size from microscopic to about 3 cm.

14. The method of claim 9, wherein said electroplating bath comprises a metal is selected from the group consisting of aluminum, antimony, bismuth, cadmium, chromium, cobalt, brass, bronze, iron, lead, copper, gold, platinum, rhodium, ruthenium, silver, tin, and zinc.

15. A method for reducing metal acid or salt evolved from electrowinning baths housed in electrowinning tanks during electrowinning operations, which comprises:

covering all of the surface of the electrowinning bath with a layer of shredded foam that floats at the surface of said bath, said shredded foam being irregular and dendritic in shape, lacking in uniform particle size, and being inert to the electrowinning operation.

16. The method of claim 15 wherein said shredded foam is selected from polymeric foam, metal foam, glass foam, and vitreous material foam.

17. The method of claim 15, wherein the layer of shredded foam is about 76–102 mm in thickness.

18. The method of claim 15, wherein said shredded foam ranges in size from microscopic to about 3 cm.

19. The method of claim 15, wherein said shredded foam is made from a material selected from the group consisting of polystyrenes, polyolefins, polycarbonates, silicones, urea/formaldehyde resins, ABS copolymers, and titanium.

20. The method of claim 15, wherein said electrowinning operations comprise the electrowinning of a metal selected from the group consisting of copper, gold, lead, and zinc.

* * * * *